US008348615B2

(12) United States Patent
Bluck et al.

(10) Patent No.: US 8,348,615 B2
(45) Date of Patent: Jan. 8, 2013

(54) TURBINE ENGINE ROTOR DISC WITH COOLING PASSAGE

(75) Inventors: Richard Bluck, Welton (GB); Paul Jacklin, Lincoln (GB)

(73) Assignee: Siemens Aktiengesellschaft, München (DE)

( * ) Notice: Subject to any disclaimer, the term of this patent is extended or adjusted under 35 U.S.C. 154(b) by 453 days.

(21) Appl. No.: 12/310,285

(22) PCT Filed: Aug. 15, 2007

(86) PCT No.: PCT/EP2007/058434

§ 371 (c)(1),
(2), (4) Date: Feb. 19, 2009

(87) PCT Pub. No.: WO2008/022954

PCT Pub. Date: Feb. 28, 2008

(65) Prior Publication Data

US 2010/0014958 A1 Jan. 21, 2010

(30) Foreign Application Priority Data

Aug. 23, 2006 (EP) ..... 06017536

(51) Int. Cl.
*F01D 5/18* (2006.01)

(52) U.S. Cl. ..... 416/97 R; 415/115

(58) Field of Classification Search ..... 415/115; 416/97 R

See application file for complete search history.

(56) References Cited

U.S. PATENT DOCUMENTS

| | | | | |
|---|---|---|---|---|
| 4,505,640 | A | 3/1985 | Hsing et al. | |
| 5,609,779 | A | 3/1997 | Crow et al. | |
| 5,888,049 | A * | 3/1999 | Broadhead et al. | 416/96 R |
| 6,022,190 | A * | 2/2000 | Schillinger | 416/96 R |
| 6,176,676 | B1 | 1/2001 | Ikeda et al. | |
| 6,234,755 | B1 * | 5/2001 | Bunker et al. | 416/97 R |
| 6,243,948 | B1 * | 6/2001 | Lee et al. | 29/889.1 |
| 6,307,175 | B1 * | 10/2001 | Blochlinger et al. | 219/121.71 |
| 6,383,602 | B1 * | 5/2002 | Fric et al. | 428/131 |
| 7,328,580 | B2 * | 2/2008 | Lee et al. | 60/752 |
| 8,079,812 | B2 * | 12/2011 | Okita | 416/97 R |
| 2004/0200807 | A1 | 10/2004 | Forrester et al. | |

FOREIGN PATENT DOCUMENTS

| | | | |
|---|---|---|---|
| EP | 0 814 233 | B1 | 12/1997 |
| EP | 1 043 480 | A2 | 10/2000 |
| EP | 1 101 563 | A2 | 5/2001 |
| EP | 1 609 949 | A1 | 12/2005 |

* cited by examiner

*Primary Examiner* — Matthew Landau
*Assistant Examiner* — Joseph C Nicely

(57) ABSTRACT

Disclosed is a gas turbine engine rotor disc with a plurality of cooling passages having an essentially radial orientation relative to an axis of rotation of the rotor disc, each cooling passage having an inlet and an outlet and being included relative to a rotor disc surface and a cut-out arranged at the passage at an outlet end of the passage. Each cooling passage terminating in a slot is arranged in the periphery of the rotor disc. Each slot is sized and configured to receive a glade root.

17 Claims, 3 Drawing Sheets

TURBINE ENGINE ROTOR DISC WITH COOLING PASSAGE

CROSS REFERENCE TO RELATED APPLICATIONS

This application is the US National Stage of International Application No. PCT/EP2007/058434, filed Aug. 15, 2007 and claims the benefit thereof. The International Application claims the benefits of European Patent Office application No. 06017536.1 DE filed Aug. 23, 2006, both of the applications are incorporated by reference herein in their entirety.

FIELD OF THE INVENTION

The invention relates to a turbine engine rotor disc and the stress reduction in the at least one cooling passage extending there-through in an essentially radial direction with respect to the axis of rotation of the rotor disc.

BACKGROUND OF THE INVENTION

Gas turbine engines typically include several rotor discs which carry a plurality of rotor blades extending radially outwardly into the hot working medium gases which makes it usually necessary to provide cooling to the blades. To remove heat from the rotor blades, cooling air is tapped from the engine's compressor and directed into passages within the disc and blade interiors. The cross-section of the passages is typically circular, since this is the cheapest and easiest to produce. During operation, rotational forces induce tangential stress in the disc material where the openings of the cooling air passages are subject to major hoop stresses with a high risk of crack initiation.

EP 0 814 233 B1 describes a gas turbine engine rotor disc with radially extending cooling air supply passages, each passage having a cross-sectional configuration which renders the ends of passages less likely to act as site of hoop-stress induced cracks.

U.S. Pat. No. 4,344,738 describes a gas turbine engine rotor disc with cooling air holes where the elongated axis of each cooling air hole lies in a plane perpendicular to the axis of symmetry of the disc to reduce tangential stress concentration factors.

U.S. Pat. No. 4,522,562 describes the cooling of turbine rotors where the disc is equipped with two sets of channels bored respectively close to each of the sides of the disc and in conformity with its profile in which the cooling air of the turbine blades flows in order to cool the disc.

SUMMARY OF THE INVENTION

An object of the invention is to provide an improved gas turbine rotor disc, especially a new cooling passage geometry for a gas turbine engine rotor disc leading to a longer disc lifetime due to a greater resistance to crack initiation at the outer openings of rotor disc cooling passages.

This object is achieved by the claims. The dependent claims describe advantageous developments and modifications of the invention.

An inventive rotor disc with cooling passages comprises a plurality of passages having an essentially radial orientation relative to an axis of rotation of the rotor disc with a slight downstream inclination relative to the flow of hot gases in the turbine, each passage having an inlet opening and an outlet opening. When rotating at very high speed, the disc generates high levels of hoop stress especially in the disc rim acting in circumferential direction of the disc. These stresses could result in the formation of cracks in the outlet openings of the cooling passages in the disc rim. This crack formation is favoured by acute edges in the outlet opening especially when the profile runs along a circumferential direction of the disc. A cut-out is arranged at the passage at an outlet opening end of the passage to remove the sharp-edged portion of the outlet opening. The profile of the cut-out is contoured for example as a compound radius and has a first central radius and a second peripheral radius, where the first radius is larger than the second radius and both radii are merging tangentially to achieve a smooth transition.

Such a design of the rotor disc with cooling passage is an optimum compromise in terms of stress concentrations induced by hoop stresses in the disc rim and radial stresses in the disc post. As a result, the peak stress is reduced thus enhancing the fatigue life of the component.

BRIEF DESCRIPTION OF THE DRAWINGS

The invention will now be further described with reference to the accompanying drawings in which.

Figure 1:
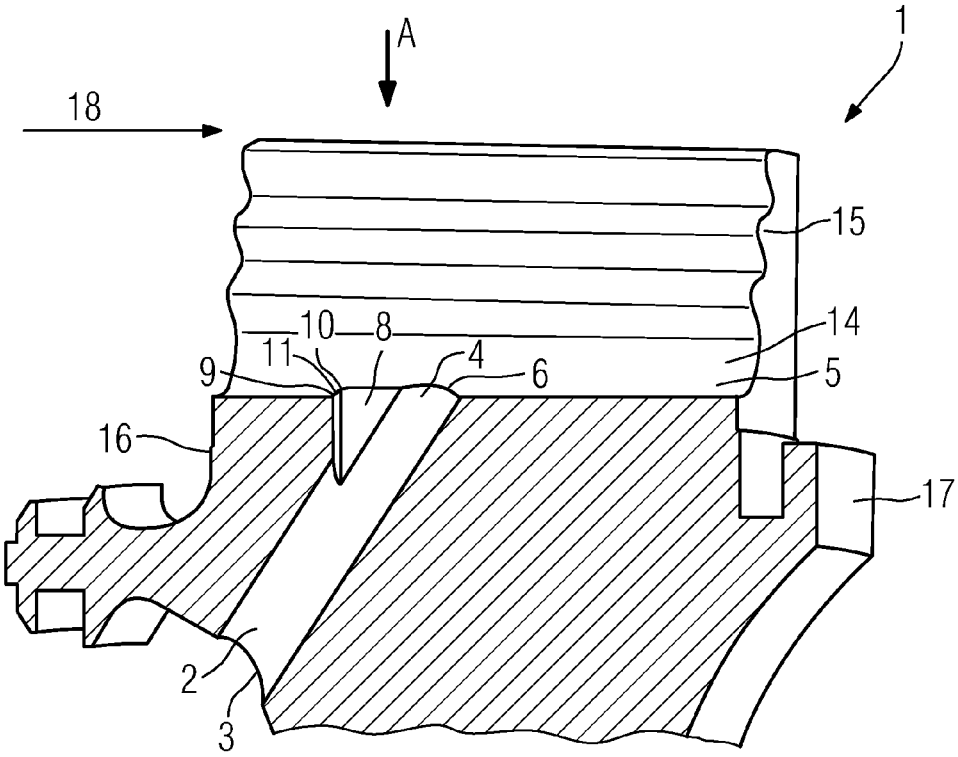
FIG. 1 represents a partial section of a rotor disc.

In the drawings like references identify like or equivalent parts.

DETAILED DESCRIPTION OF THE INVENTION

FIG. 1 is a perspective view of part of a turbine rotor disc 1. The sectional plane contains the rotation axis of the disc as well as the axis of a cooling air passage 2 with circular cross-section. FIG. 1 shows the sectional plane and a downstream face 17 of the disc relative to the flow direction of hot gases in the turbine. A passage 2 extends from an upstream face 16 of the disc relative to a hot gas stream 18 to a rotor disc surface 5. The passage 2 has an inlet 3 and an outlet 4 and is for obvious technical reasons inclined in an axially downstream direction, since the conventional place for the blade cooling air inlet is close to the axially mid-region of the blade root (not shown). The outlet 4 is therefore arranged in the surface of the disc rim and situated in a blade root slot 14 formed by fir tree shaped disc posts 15. The more the passage 2 is inclined the more likely is the hoop-stress-induced formation of cracks in the upstream acute-edged portion of the outlet 4 at high rotation speed. The opposing obtuse-angled portion of the outlet 4 is resistant to the formation of hoop stress-induced cracking.

In order to enhance the resistivity of the upstream part of the outlet 4 the acute-edged portion is cut out in a radial direction relative to the rotation axis of the rotor disc 1. The upstream profile of the cut-out 8 is contoured as a compound radius having a first central radius 12 and a second peripheral radius 13, the first radius 12 being larger than the second radius 13. The ratio of the first and the second radius falls into the range 2:1 to 20:1.

Figure 2:
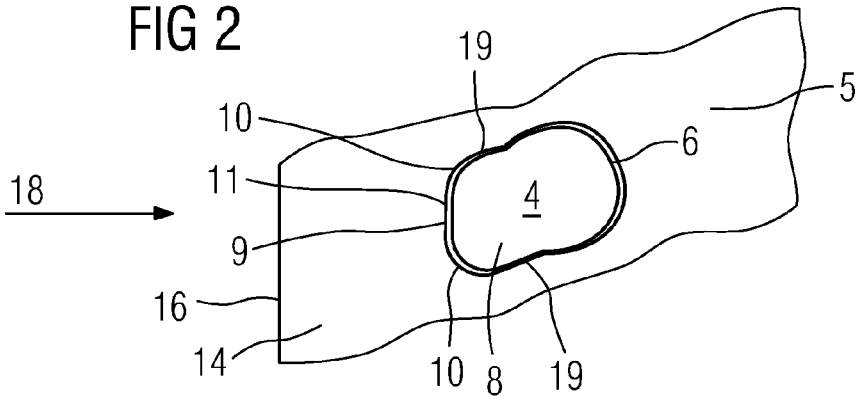
FIG. 2 is a view on arrow A of FIG. 1 showing the outlet opening profile.

FIG. 2 shows the view on a rotor disc 1 in the direction indicated by the arrow A of FIG. 1. The outlet 4 of the passage 2 is positioned in a slot 14 formed by two disc posts 15. Since the inlet 3 of the essentially straight passage 2 is on the upstream face 16 of the disc the cut-out 8 is arranged on the upstream side of the outlet 4 facing an obtuse edge 6. As can be seen from FIG. 2 a first border portion 9 of the cut-out 8 where the border 11 is parallel to a direction of rotation of the rotor disc 1 and perpendicular to the axis of rotation of the rotor disc 1 is less curved than the second border portions 10 where the border 11 of the cut-out 8 forms smooth transitions to third border portions 19 which are almost perpendicular to the direction of rotation of the rotor disc 1 and almost parallel to the axis of rotation of the rotor disc 1.

The difference between the prior art and the present invention is illustrated with regard to FIGS. 3, 4, 5 and 6.

Figure 3:
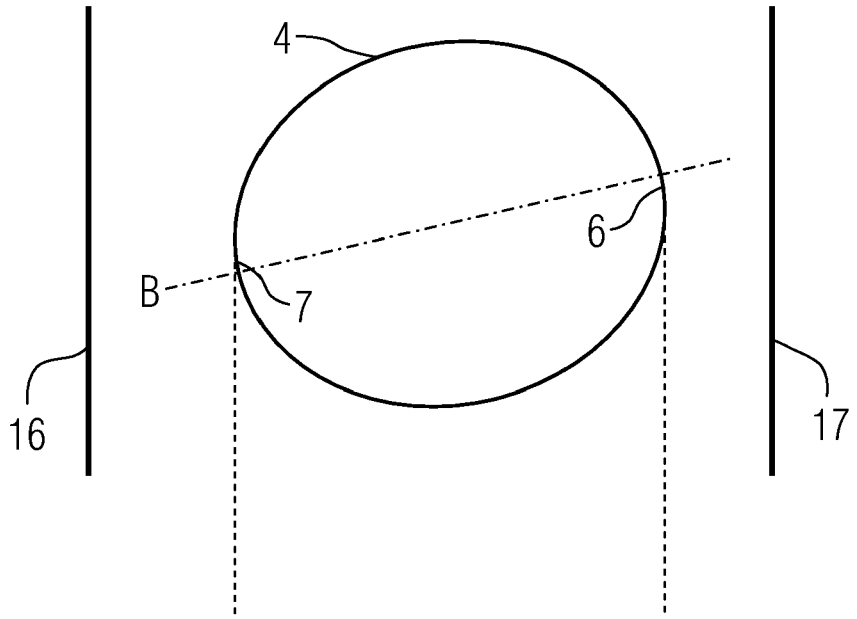
FIG 3 (PRIOR ART)
FIG. 3 represents a top view of a passage with circular cross-section.
Figure 4:
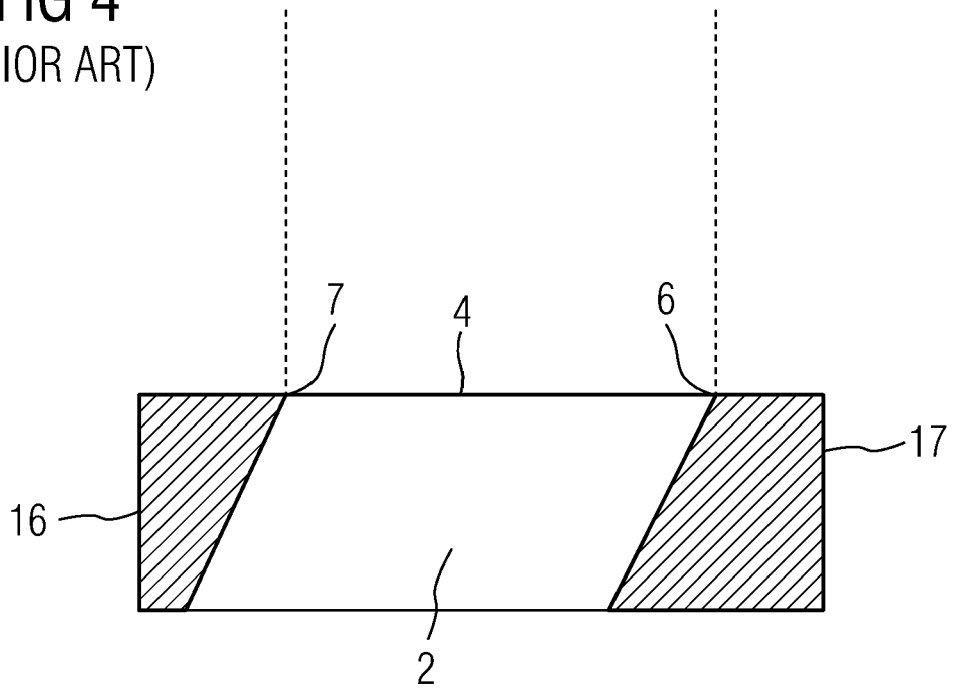
FIG 4 (PRIOR ART)
FIG. 4 represents a side view of a passage with circular cross-section.

With reference to FIG. 3, the top view of an inclined passage 2 with circular cross-section shows an elliptical outlet 4. FIG. 4 shows the geometry of the passage 2 when cutting through line B in FIG. 3 along an axis of the passage 2. The outlet 4 has sharp and obtuse edges 7,6.

Figure 5:
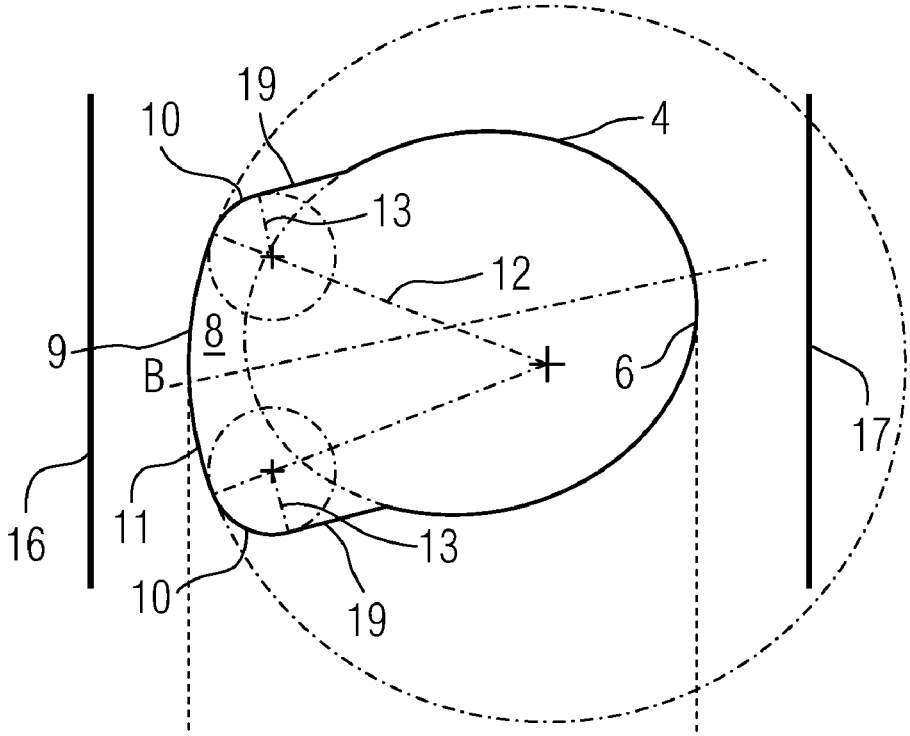
FIG. 5 represents a top view of the cut-out geometry.
Figure 6:
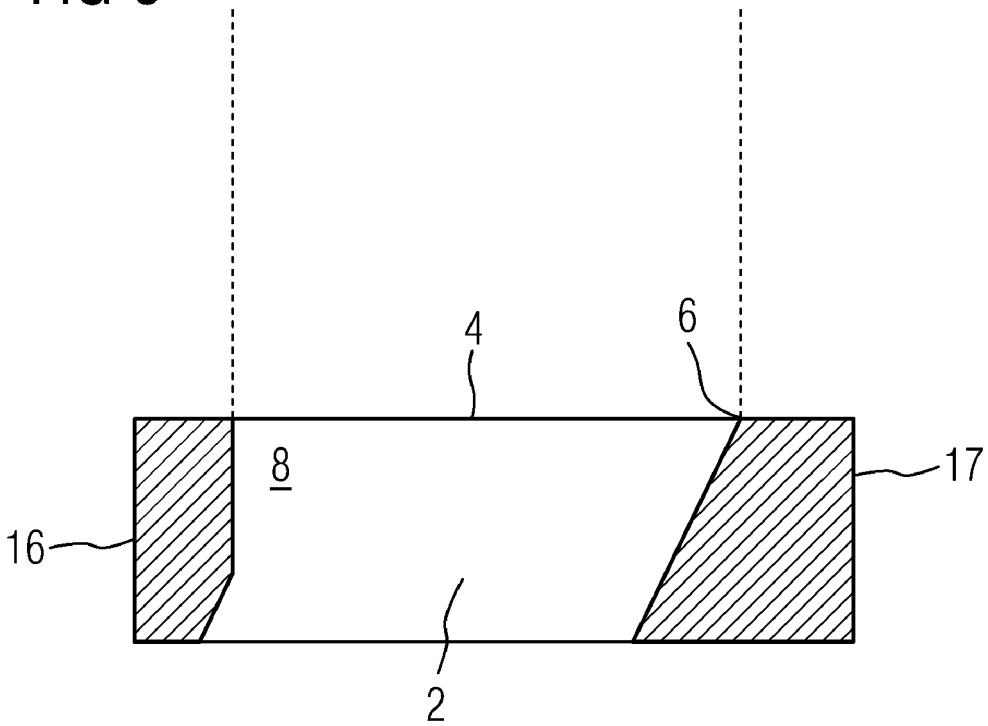
FIG. 6 represents a side view of the cut-out geometry.

FIGS. 5 and 6 represent top and side views of a passage 2 with circular cross-section and a cut-out 8 at the outlet 4. FIG. 5 shows the geometry of the cut-out 8 in detail. The border 11 of the cut-out 8 is contoured as a compound radius. A first border portion 9 is a segment of a circle with a first radius 12 and is neighboured by second border portions 10 which are segments of circles with a second radius 13, the second radius 13 being smaller than the first radius 12. Transitions between the segments are tangential. The border 11 forms smooth transitions to third border portions 19 which are almost perpendicular to the direction of rotation of the rotor disc 1 and almost parallel to the axis of rotation of the rotor disc 1. FIG. 6 shows the geometry of the passage 2 with removed sharp edges 7 when cutting through line B in FIG. 5 along an axis of the passage 2.

In an alternative arrangement the compound radius may be defined by more than two different radii.

In another alternative arrangement the compound radius may also be defined by a polynomial or a combination of one or more radii and a polynomial.

The invention claimed is:

1. A gas turbine engine rotor disc, comprising:
a rotor disc surface;
a plurality of passages having an essentially radial orientation relative to an axis of rotation of the rotor disc, each of the plurality of passages having an inlet and an outlet and being inclined relative to the rotor disc surface wherein the outlet is arranged in the rotor disc surface; and
a cut-out in the form of a notch or indention in the rotor disc surface arranged at the outlet end of at least one of the plurality of passages and having a depth,
wherein the at least one of the plurality of passages is inclined in an axially downstream direction relative to a hot gas stream so that the respective cut-out is arranged at an upstream edge of the outlet, and
wherein the diameter of each passage gradually increases from the end of the cut-out closest to the inlet to the outlet due to the cut-out.

2. The gas turbine engine rotor disc as claimed in claim 1, wherein the cut-out has a first border portion and a plurality of second border portions, the first border portion being less curved than each of the plurality of second border portions.

3. The gas turbine engine rotor disc as claimed in claim 2, further comprising:
a border which includes the first border portion and the plurality of second border portions,
wherein the border is contoured as a compound radius having a first central radius and a second peripheral radius,
wherein the first central radius is larger than the second peripheral radius.

4. The gas turbine engine rotor disc as claimed in claim 3, wherein a ratio of the first radius and the second radius is in a range of 2:1 to 20:1.

5. The gas turbine engine rotor disc as claimed in claim 4, wherein the ratio of the first and the second radius is in a range of 4:1 to 10:1.

6. The gas turbine engine rotor disc as claimed in claim 5, wherein the ratio is 10:1.5.

7. The gas turbine engine rotor disc as claimed in claim 3, wherein the compound radius is defined by a plurality of different radii.

8. The gas turbine engine rotor disc as claimed in claim 1,
wherein each of the plurality of passages terminates in a slot arranged in a periphery of the rotor disc,
wherein each slot is sized and configured to receive a blade root.

9. The gas turbine engine rotor disc as claimed in claim 1, wherein an edge of the cut-out is chamfered and radiused.

10. A gas turbine engine, comprising:
a gas turbine rotor disc, comprising:
a rotor disc surface,
a plurality of passages having an essentially radial orientation relative to an axis of rotation of the rotor disc, each of the plurality of passages having an inlet and an outlet and being inclined relative to the rotor disc surface wherein the outlet is arranged in the rotor disc surface, and
a cut-out in a form of a notch or indention in the rotor disc surface arranged at the outlet end of at least one of the plurality of passages and having a depth,
wherein the at least one of the plurality of passages is inclined in an axially downstream direction relative to a hot gas stream so that the respective cut-out is arranged at an upstream edge of the outlet, and
wherein the diameter of each passage gradually increases from the end of the cut-out closest to the inlet to the outlet due to the cut-out.

11. The gas turbine engine as claimed in claim 10, wherein the gas turbine rotor disc further comprises the cut-out having a first border portion and a plurality of second border portions, the first border portion being less curved than each of the plurality of second border portions.

12. The gas turbine engine as claimed in claim 10,
wherein the gas turbine rotor disc further comprises a border, which includes the first border portion and the plurality of second border portions,
wherein the border is contoured as a compound radius having a first central radius and a second peripheral radius,
wherein the first central radius is larger than the second peripheral radius.

13. The gas turbine engine as claimed in claim 10,
wherein the gas turbine rotor disc further comprises a plurality of passages each of which terminates in a slot arranged in the periphery of the rotor disc,
wherein each slot is sized and configured to receive a blade root.

14. The gas turbine engine as claimed in claim 10, wherein the gas turbine rotor disc further comprises an edge of the cut-out that is chamfered and radiused.

15. The gas turbine engine as claimed in claim 10, wherein the gas turbine rotor disc further comprises a ratio of the first radius and the second radius that is in a range of 2:1 to 20:1.

16. The gas turbine engine as claimed in claim 15, wherein the ratio is in a range of 4:1 to 10:1.

17. The gas turbine engine as claimed in claim 16, wherein the ratio is 10:1.5.

* * * * *